US005524650A

United States Patent [19]

Ponce

[11] Patent Number: 5,524,650

[45] Date of Patent: Jun. 11, 1996

[54] HAIR FROSTING MASK SYSTEM

[76] Inventor: Rosario Ponce, P.O. Box 7001, Eagle Pass, Tex. 78853

[21] Appl. No.: 344,130

[22] Filed: Aug. 14, 1995

[51] Int. Cl.[6] ..... A45D 19/18

[52] U.S. Cl. ..... 132/270; 132/212; 132/200; 132/208

[58] Field of Search ..... 132/270, 200, 132/208, 212, 202, 205

[56] References Cited

U.S. PATENT DOCUMENTS

D. 351,484 10/1994 Micu ..... D28/20

3,586,009 6/1971 Simmons ..... 132/270

4,750,500 6/1988 Alen ..... 132/212

5,024,244 6/1991 Brown ..... 132/270

*Primary Examiner* John G. Weiss

*Assistant Examiner* Philogene Pedro

*Attorney, Agent, or Firm* David G. Henry

[57] ABSTRACT

A modular hair frosting masking system for selectively masking portions of a person's head for selective hair treatment procedures and for facilitating greater comfort for such person during the hair treatment operation.

5 Claims, 1 Drawing Sheet

HAIR FROSTING MASK SYSTEM

BACKGROUND OF THE INVENTION

1. Field of the Invention

Applicant's invention relates to devices useful in cosmetology.

2. Background Information

Presently, the process of "hair frosting" involves selectively applying a bleaching or dying agent to individual strands or groups of strands of hair. Once the bleaching or dying agent is applied to particular strand(s) of hair, it must remain isolated from the underlying strands of hair if the isolated coloring effect is to be maintained. In addition, the most desirable result of a hair frosting operation is that colored or dyed hair strands are uniformly dispersed over a person's hair.

"Frosting Cape" are available for generally satisfying the above objectives. Frosting caps are shower cap-like devices which overlie the entirety of an individual's head. A number of small orifices are dispersed over the entirety of the frosting cap. A cosmetologist, using a hook-like instrument, draws strands of hair through the orifices and applies the bleaching or coloring agent to such strands of hair. The treated hair strands may then lie atop the frosting cap without contaminating the underlying, untreated hair.

While most cosmetologists known to applicant strongly dislike frosting caps in their presently available form, there are no known alternatives. The problem with presently available frosting caps relates primarily to the fact that people's heads come in vastly varying sizes and shapes. Yet frosting caps are made in a one-size-fits-all manner. Not only does this produce discomfort for many cosmetology clients, it adversely effects the quality of the frosting job achieved using an ill-fitting frosting cap. When a frosting cap does not, without undue distortion or stress points, follow the contour of a client's head, it is very difficult to extract uniform quantities of hair through the various orifices. This produces an uneven frosting effect.

Another shortcoming of presently available frosting caps relates to their excessive head coverage in instances where clients wish only a portion of the hair to be frosted (just the bangs area, for example). Regardless of the portions of one's hair which a client wishes to have frosted, a frosting cap completely envelops the client's hair. In such instances, the client is unnecessarily hot and uncomfortable.

In light of the above, it would be desirable to provide some alternative to the presently available frosting caps which alternative would more satisfactorily accommodate the varying sizes and shapes of cosmetology clients' heads, would permit coverage substantially of only the areas which a client wishes to be frosted, and which would adjust in such a manner as to produce the most uniform and high quality appearing frosting job possible.

SUMMARY OF THE INVENTION

It is an object of the present invention to provide a novel and unobvious hair frosting mask system.

It is another object of the present invention to provide a novel and unobvious modular hair frosting mask system.

It is another object of the present invention to provide a novel and unobvious modular hair frosting mask system which accommodates the varying sizes and shapes of cosmetology clients' heads.

It is another object of the present invention to provide a novel and unobvious modular hair frosting mask system which permits selective masking of partial portions of a cosmetology client's hair for selective frosting operations.

In satisfaction of these and related objectives, Applicant's present invention provides a modular hair frosting masking system. Applicant's invention permits its practitioner to adjust the frosting mask to accommodate varying sizes and shapes of clients' heads, to selectively mask only portions of a client's head, and to increase, to the greatest extent possible, the client's comfort during a frosting, tipping, illuminating, highlighting, or striking operation.

BRIEF DESCRIPTION OF THE DRAWINGS

Applicant's invention may be further understood from a description of the accompanying drawings wherein, unless otherwise specified, like reference numbers are intended to depict like components in the various views.

DETAILED DESCRIPTION OF THE PREFERRED EMBODIMENT

Referring to FIG. 1 through 6, applicant's modular hair frosting masking system includes three primary components—a front cap member 10, a middle cap member 12, and a rearward cap member 14.

Figure 1:
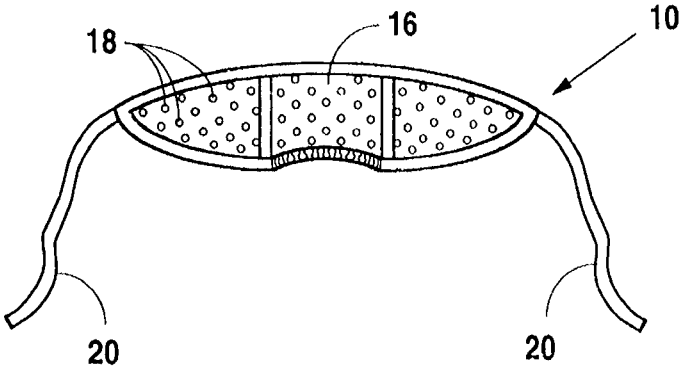
FIG. 1 is a perspective view of the front cap member of applicant's modular hair frosting masking system.
Figure 2:
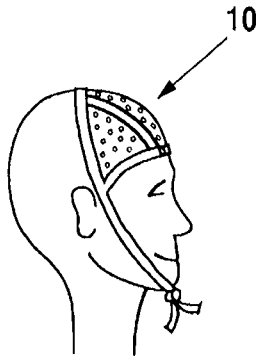
FIG. 2 is an elevational side view of the front cap member of FIG. 1 shown on a wearer.

Referring principally to FIGS. 1 and 2, forward cap member 10 includes a masking panel 16 which is fabricated, in the preferred embodiment, from perforated vinyl sheeting. Access orifices 18 are uniformly dispersed over the masking panel 16. A facing material is affixed to the purifier of the masking panel 16 and extends on either end of masking panel 16 as retention straps 20. Masking panel 16 is configured to accommodate the bulbus like structure of the forward conium of a cosmetology client. A portion of the periphery of masking panel 16 is gathered and elasticized to form a stretch panel 22. Stretch panel 22 aids in conforming forward cap member 10 to a client's forehead region.

Figure 3:
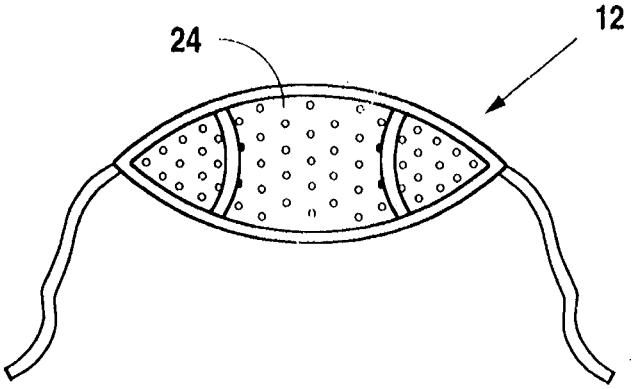
FIG. 3 is a prospective view of the middle cap member of applicant's masking system.
Figure 4:
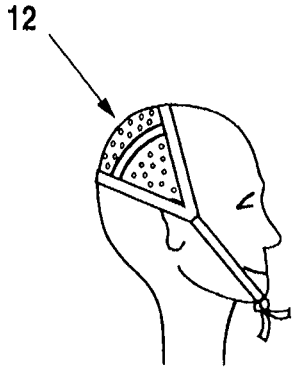
FIG. 4 is an elevational side view of the middle cap member of FIG. 3 shown on a wearer.

Referring principally to FIGS. 3 and 4, middle cap member 12 is constructed in much the same manner as forward cap member 10. However, the masking panel 24 of middle cap member 12 is contoured to accommodate less of a protrusion into the space bounded by the masking panel's periphery, when compared to the masking panel 16 of forward cap member 10. As is apparent from FIG. 4, the masking panel 24 of middle cap member 12 need not accommodate such a bulbus protrusion as does forward cap member 10 because of the portion of the client's head which it overlies.

Figure 5:
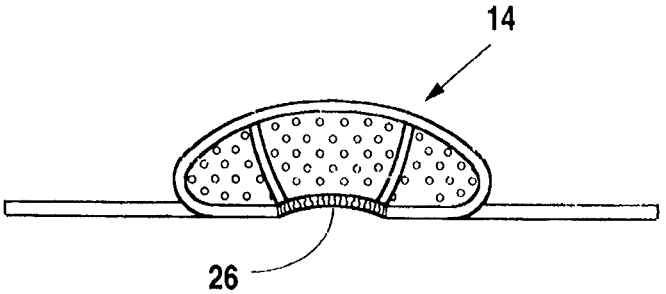
FIG. 5 is a perspective view of the rear cap member of applicant's masking system of FIG. 1.

Referring to FIGS. 5 and. 6, the rearward cap member 14 is most similarly constructed to forward cap member 10. Again, the physiology of the portion of the head for which rearward cap member 14 is intended is such that rearward cap member 14 must accommodate a more bulbus protrusion than middle cap member 12. As with forward cap member 10, rearward cap member 14 includes a stretch panel 26 which ensures an effective interface between the lower, central marginal portion of rearward cap member 14 and a cosmetology client's lower-most cranial margin.

Figure 6:
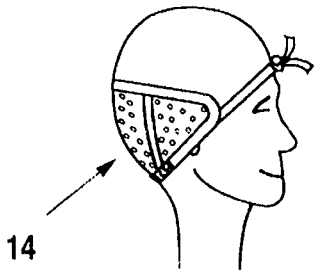
FIG. 6 is an elevational side view of the cap member of applicant's masking system of FIG. 5.

As the views of FIGS. 2, 4 and 6 clearly show, applicant's modular system permits selective masking of portions of a client's hair. Less apparent, however, is the fact that applicant's modular system is far preferable than existing unitary construction frosting caps, even when a client desires treatment of his or her entire compliment of hair. Because each cap member 10, 12 & 14 may be independently configured for the best possible fit, use of all three cap members 10, 12 and 14 provide a much more effective, "custom fit" than a single piece frosting cap as is now available on the market. This "custom fit" produces a far superior result from frosting operations than do one piece frosting caps for reasons discussed in the background information section. Additionally, applicant's clients who wore the modular masking system reported considerably better comfort than experienced during prior uses of single piece frosting caps.

With respect to each of cap members 10, 12 and 14, the stitchery involved in contouring the masking panels are well known in the related arts, and need not be elaborated here for providing an enabling disclosure.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A modular hair frosting masking system comprising:

a first mask member, said first mask member being configured substantially of a shell of perforated sheeting material, said sheeting material being configured to overlie a first portion of a person's head;

a second mask member, said second mask member being configured substantially of a shell of perforated sheeting material, said sheeting material being configured to overlie a second portion of a person's head;

said first anti second mask members having affixation means attached thereto for securing said first and second mask members to said persons's head and maintaining a desired juxtaposition between said persons head and, respectively, said first and second mask members.

2. The invention of claim 1 further comprising a third mask member constructed of perforated sheeting material, said third mask member being configured to overlie a third portion of said person's head not inclusive of said first or second said portions of said person's head.

3. The invention of claim 1 wherein said perforated sheeting material is a plastic sheeting having a substantially uniform distribution of access holes formed throughout said sheeting material.

4. The invention of claim 1 wherein said affixation means are cords which depend from said first and second mask members and serve as ties for drawing said sheeting material of said first and second mask members closely against said person's head.

5. A method of applying a hair treatmemt preparation comprising the steps of:

selecting a first hair frosting mask member constructed substantially of perforated plastic sheeting material and configured to overlie and closely juxtapose a first portion of a person's head, said first hair frosting mask member having first cords attached thereto for drawing said sheeting material of said first hair frosting mask member closely against said first portion of said person's head;

positioning said first hair frosting mask member to overlie said first poriton of said person's head and securing said first hair frosting mask member in such position using said first cords;

selecting a second hair frosting mask member constructed substantially of perforated plastic sheeting material and configured to overlie and closely juxtapose a second portion of a person's head, said second hair frosting mask member having second cords attached thereto for drawing said sheeting material of said second hair frosting mask member closely against said second portion of said person's head;

positioning said second hair frosting mask member to overlie said second poriton of said person's head and securing said second hair frosting mask member in such position using said second cords;

drawing strands of hair from said person's head through holes in said perforated sheeting material of said first and second hair frosting mask members; and applying hair treatment preparation to said strands of hair.

* * * * *